US006148545A

United States Patent [19]

Yeager, Jr.

[11] Patent Number: 6,148,545

[45] Date of Patent: Nov. 21, 2000

[54] BOOT WARMER

[76] Inventor: James L. Yeager, Jr., P.O. Box 1769, Conway, N.H. 03818

[21] Appl. No.: 09/405,093

[22] Filed: Sep. 27, 1999

[51] Int. Cl.[7] ..... A43B 7/02

[52] U.S. Cl. ..... 36/2.6; 36/1; 223/51; 12/129.4; 12/128 R

[58] Field of Search ..... 36/2.6, 1; 12/129.4, 12/128 R; 223/51; 34/103, 104; 165/10 A, 46

[56] References Cited

U.S. PATENT DOCUMENTS

| | | | |
|---|---|---|---|
| 896,536 | 8/1908 | Hayden | 12/128 R |
| 1,199,914 | 10/1916 | Mossor | 165/46 |
| 1,270,666 | 6/1918 | Smith | 12/129.4 |
| 5,050,598 | 9/1991 | Tucker . | |
| 5,291,669 | 3/1994 | Khoury et al. | 36/1 |
| 5,331,688 | 7/1994 | Kiyohara . | |
| 5,341,532 | 8/1994 | Markowitz | 12/128 R |
| 5,357,693 | 10/1994 | Owens | 36/71 |
| 5,542,191 | 8/1996 | Shouse et al. | 34/104 |
| 5,623,772 | 4/1997 | Sunderland et al. . | |
| 5,642,574 | 7/1997 | Caddy . | |
| 5,992,045 | 11/1999 | Kellogg et al. | 34/442 |

*Primary Examiner*—Paul T. Sewell
*Assistant Examiner*—Troy Arnold
*Attorney, Agent, or Firm*—Joseph H. McGlynn

[57] ABSTRACT

A foot warmer which has a shape to fit into a boot and an insulating foam adjacent the top of the warmer. Below the insulating foam is a heat retaining material that can be heated in a microwave.

12 Claims, 1 Drawing Sheet

BOOT WARMER

BACKGROUND OF THE INVENTION

This invention relates, in general, to footwear, and, in particular, to footwear that can be heated.

DESCRIPTION OF THE PRIOR ART

In the prior art various types of footwear have been proposed. For example, U.S. Pat. No. 5,623,772 to Sunderland et al discloses a foot warming system which is powered by a battery pack mounted on a pair of boots.

U.S. Pat. No. 5,331,688 to Kiyohara discloses a disposable foot warmer comprising an inner bag applied to socks or stocking to warm the feet.

U.S. Pat. No. 5,642,574 to Caddy discloses a heating packet applied to boots to warm the boots. U.S. Pat. No. 5,050,598 to Tucker discloses a foot warmer which is a bladder which can be filled with a warm liquid.

SUMMARY OF THE INVENTION

The present invention is directed to a foot warmer which has a shape to fit into a boot and an insulating foam adjacent the top of the warmer. Below the insulating foam is a heat retaining material that can be heated in a microwave.

It is an object of the present invention to provide a new and improved boot warmer.

It is an object of the present invention to provide a new and improved boot warmer that does not require batteries.

It is an object of the present invention to provide a new and improved boot warmer that can be used with any style or size of boot.

These and other objects and advantages of the present invention will be fully apparent from the following description, when taken in connection with the annexed drawings.

DESCRIPTION OF THE PREFERRED EMBODIMENT

Figure 1:
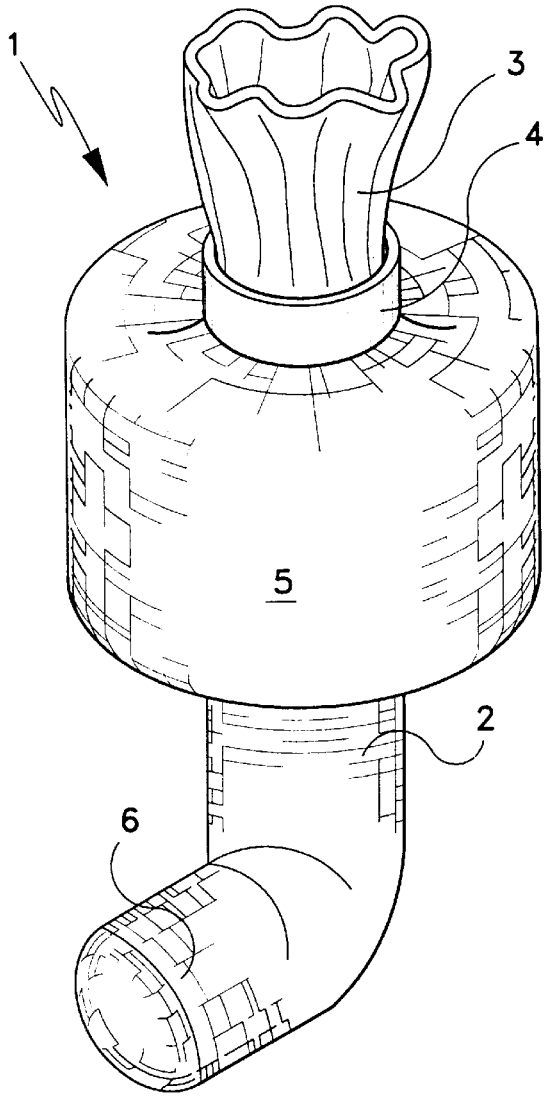
FIG. 1 is perspective view of the present invention.

Referring now to the drawings in greater detail, FIG. 1 shows the boot warmer 1 of the present invention. The boot warmer is shaped like a sock that will be inserted into boots such as, but not limited to, ski or snowboard boots. The warmer will be made from a knit, synthetic sock-like material. The warmer has a top portion 3, an intermediate portion 2 and a bottom portion 6. Also, while only one boot warmer 1 is shown in the drawings, it should be understood that a pair of boot warmers, one for each boot, will be used.

Figure 2:
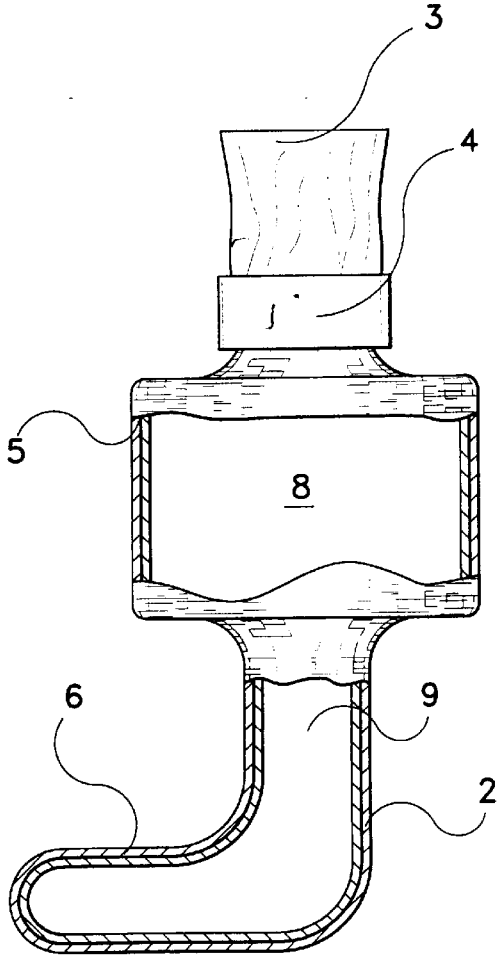
FIG. 2 is a partial cross-sectional view of the present invention.
Figure 3:
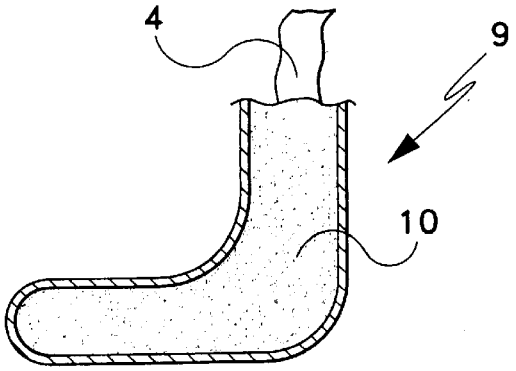
FIG. 3 is a cross-sectional view of the heatable insert of the present invention.

As shown in FIG. 2, a container 9 made from any conventional synthetic material will be filled with a material 10 (see also FIG. 3) that is inert, non-toxic and can retain heat. The top of the container 9 will be fastened at 4 by a knot or by any other conventional fastener to retain the heat retaining material in the contained. The container 9 will be inserted into the warmer 1 so it occupies the intermediate portion 2 and a bottom portion 6, as shown in FIG. 2.

Next, a round insulating material such as, but not limited to, foam 8 is inserted into the top 3 of the warmer and rests just above the containers, for a reason to be explained below.

After the foam insulation 8 is inserted into the warmer into the area 5, just above the area 2, the top of the warmer 3 will be secured with a knot or by any other conventional fastener 4.

In order to use the present invention a user would insert a pair of warmers 1 into a microwave and heat on high for 70–90 seconds, depending on the power output of the microwave. Next the warmers will be inserted into the boots. The heatable material 10 within the container 9 will slowly give off the heat they have accumulated from the microwave heating and warm the boots they are placed in. In addition the warmer can be used with boots that have been worn in the snow to dry the boots from the inside.

The insulating material 8 will help hold the heat in the inside of the boot, which is the hardest area to dry or to warm Although the Boot Doggies and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A boot warming device comprising:

an outer covering, said outer covering comprising a top portion, an intermediate portion and a bottom portion, said outer covering having an outer diameter, container means for holding a heatable material, heatable material in said container means, said container means positioned within said intermediate portion and said bottom portion of said covering, an insulating material, said insulating material positioned between said container means and said top portion of said covering, said insulating material having an outer diameter which is larger than the outer diameter of said outer covering.

2. The boot warming device as claimed in claim 1, wherein said covering has a fastener means for securing the top portion of said covering.

3. The boot warming device as claimed in claim 1, wherein said insulating material is circular.

4. The boot warming device as claimed in claim 1, wherein said covering is made from a synthetic material.

5. The boot warming device as claimed in claim 1, wherein said heatable material is made from an inert, non-toxic heat retaining material.

6. The boot warming device as claimed in claim 1, wherein said heatable material is made from a material that can be microwavable.

7. A boot warming device comprising:

an outer covering, said outer covering comprising a top portion, an intermediate portion and a bottom portion, said outer covering having an outer diameter, container means for holding a heatable material, heatable material in said container means, said container means positioned within said intermediate portion and said bottom portion of said covering, an insulating material, said insulating material positioned solely between said container means and said top portion of the bottom portion of the covering.

8. The boot warming device as claimed in claim 7, wherein said covering has a fastener means for securing the top portion of said covering.

9. The boot warming device as claimed in claim 7, wherein said insulating material is circular.

10. The boot warming device as claimed in claim 7, wherein said covering is made from a synthetic material.

11. The boot warming device as claimed in claim 7, wherein said hatable material is made from an inert, non-toxic heat retaining material.

12. The boot warming device as claimed in claim 7, wherein said hatable material is made from a material that can be microwavable.

* * * * *